United States Patent [19]

Heys, Jr.

[11] 4,066,850

[45] Jan. 3, 1978

[54] KEYBOARD SWITCH ASSEMBLY HAVING INTERCHANGEABLE COVER PLATE, INDICATING LAYER AND ACTUATOR SWITCH ASSEMBLY IN ANY OPERATIVE COMBINATION

[75] Inventor: George Heys, Jr., Byesville, Ohio

[73] Assignee: NCR Corporation, Dayton, Ohio

[21] Appl. No.: 693,032

[22] Filed: June 4, 1976

[51] Int. Cl.[2] ..... H01H 9/00; H01H 13/00

[52] U.S. Cl. ..... 200/5 A; 174/66; 200/159 B; 200/293; 200/309; 235/145 R

[58] Field of Search ..... 200/1 R, 5 R, 5 A, 86 R, 200/159 R, 159 A, 159 B, 46, 293, 302, 308, 329, 330, 340, 295, 309; 174/66 X, 38, 66; 220/241; 235/145 R; 197/98, 100, 105; 340/365 R, 365 S

[56] References Cited

U.S. PATENT DOCUMENTS

| | | | |
|---|---|---|---|
| 1,673,724 | 6/1928 | Vickers | 197/105 |
| 3,438,534 | 4/1969 | Zerwes | 220/241 |
| 3,551,616 | 12/1970 | Juliusburger et al. | 340/365 S X |
| 3,560,964 | 2/1971 | Bedell et al. | 340/365 R |
| 3,585,456 | 6/1971 | Phillips, Jr. | 174/38 X |
| 3,591,749 | 7/1971 | Comstock | 200/308 |
| 3,592,979 | 7/1971 | Redman | 200/86 R X |
| 3,617,660 | 12/1971 | Krakinowski | 200/86 R X |
| 3,823,309 | 7/1974 | Caruso | 200/5 A X |
| 3,899,101 | 8/1975 | Keating | 174/66 X |
| 3,995,126 | 11/1976 | Larson | 200/159 B X |

OTHER PUBLICATIONS

Johnson, D. R., "Keyboard with Changeable Encoding and Key Designation", IBM Tech. Disc. Bull., vol. 13, No. 7, Dec. 1970, pp. 2041, 2042.

*Primary Examiner*—James R. Scott
*Attorney, Agent, or Firm*—J. T. Cavender; Wilbert Hawk, Jr.; Richard W. Lavin

[57] ABSTRACT

A printed circuit keyboard assembly is disclosed comprising a waterproof jacket portion which includes a cover member overlying a sheet of raised key-tip portions, the jacket portion being releasably mounted to a position adjacent the waterproof switch matrix portion. Depression of a key-tip portion will result in the deflection of the switch matrix portion thereby generating binary coded signals representing the key-tip portion depressed. The cover member secured to the jacket portion is constructed to expose a predetermined number of key-tip portions for operation. Means are provided to releasably secure the jacket portion to a position adjacent the matrix portion to allow the interchanging of jacket portions each having different numbers of key-tip portions available for depression to meet changing business conditions.

8 Claims, 4 Drawing Figures

KEYBOARD SWITCH ASSEMBLY HAVING INTERCHANGEABLE COVER PLATE, INDICATING LAYER AND ACTUATOR SWITCH ASSEMBLY IN ANY OPERATIVE COMBINATION

BACKGROUND OF THE INVENTION

The present invention is directed to data terminal devices in general and more particularly to the keyboard for such terminal devices. Data terminal devices are normally designed to be operated under the widest possible business conditions without requiring any major modification to their structure. One business area that has required such a modification has been the fast food industry wherein terminal devices operating in such business environments have been subject to accidental spillage of drinks and food on the keyboard of the terminal device and thereby disabling the use of the device. In addition, menu changes occur from day to day and in some instances during the same day requiring that the classification captions on the keys of the keyboard be changed. To solve these problems, waterproof auxiliary keyboards have been constructed for use on the keyboard of the terminal device which prevents the disabling of the terminal device when such accidental spillage occurs. An example of the construction of such an auxiliary keyboard is disclosed in U.S. Pat. application Ser. No. 641,411, filed Dec. 16, 1975 in the name of W. R. Bradam and assigned to the assignee of the present application. While this type of keyboard solves the above-cited problems, its use is obviously an added expense to the overall cost of the data terminal device. It is therefore the principal object of the present invention to provide an improved keyboard for a data terminal device which will operate under a variety of business environments including those where liquids and food may accidentally be spilled on the keyboard.

Another object of this invention is to provide a keyboard for a data terminal device which is capable of having the number and location of the keys that are operable be changed to accommodate different business conditions. It is a further object of this invention to provide a keyboard which is capable of having the key classification indicia changed. It is another object of this invention to provide a keyboard of a data terminal device which is low in cost and capable of being used remotely from the terminal device.

SUMMARY OF THE INVENTION

In order to fulfill these objects, there is provided a low cost keyboard assembly consisting of a waterproof printed circuit switch matrix unit and a waterproof jacket. The matrix unit includes a flexible printed circuit board having a plurality of electrical conductors imbedded in its lower surface, an insulating sheet positioned adjacent the lower surface of the flexible circuit board having apertures therein and a second printed circuit board having a plurality of electrical conductors embedded in its upper surface adjacent the insulating sheet and extending at right angles to the conductors on the flexible printed circuit board. The matrix unit is sealed to form a waterproof assembly. The waterproof jacket includes a first sheet of flexible material containing a plurality of depending projections, a transparent sheet of flexible material containing a plurality of raised key tip portions, each key tip being oriented with a corresponding projection, the first sheet and the transparent sheet being mounted in a cover member in a spaced apart relationship forming a pocket within which is slidably positioned a sheet having key tip indicia printed thereon, the cover member being constructed to extend over the transparent sheet and to expose a predetermined number of key tip portions for operation. Means are further provided to releasably secure the jacket to a position adjacent the matrix unit whereby depressing of a key tip portion will move its corresponding projection into engagement with the flexible circuit board thereby forcing the circuit board through an aperture of the insulating sheet resulting in the conductors embedded in the flexible circuit board engaging the conductors in the second printed circuit board to generate binary coded signals representing the key tip depressed.

BRIEF DESCRIPTION OF THE DRAWINGS

Additional advantages and features of the present invention will become apparent and fully understood from a reading of the following description taken together with the annexed drawing, in which.

DESCRIPTION OF A PREFERRED EMBODIMENT

Figure 1:
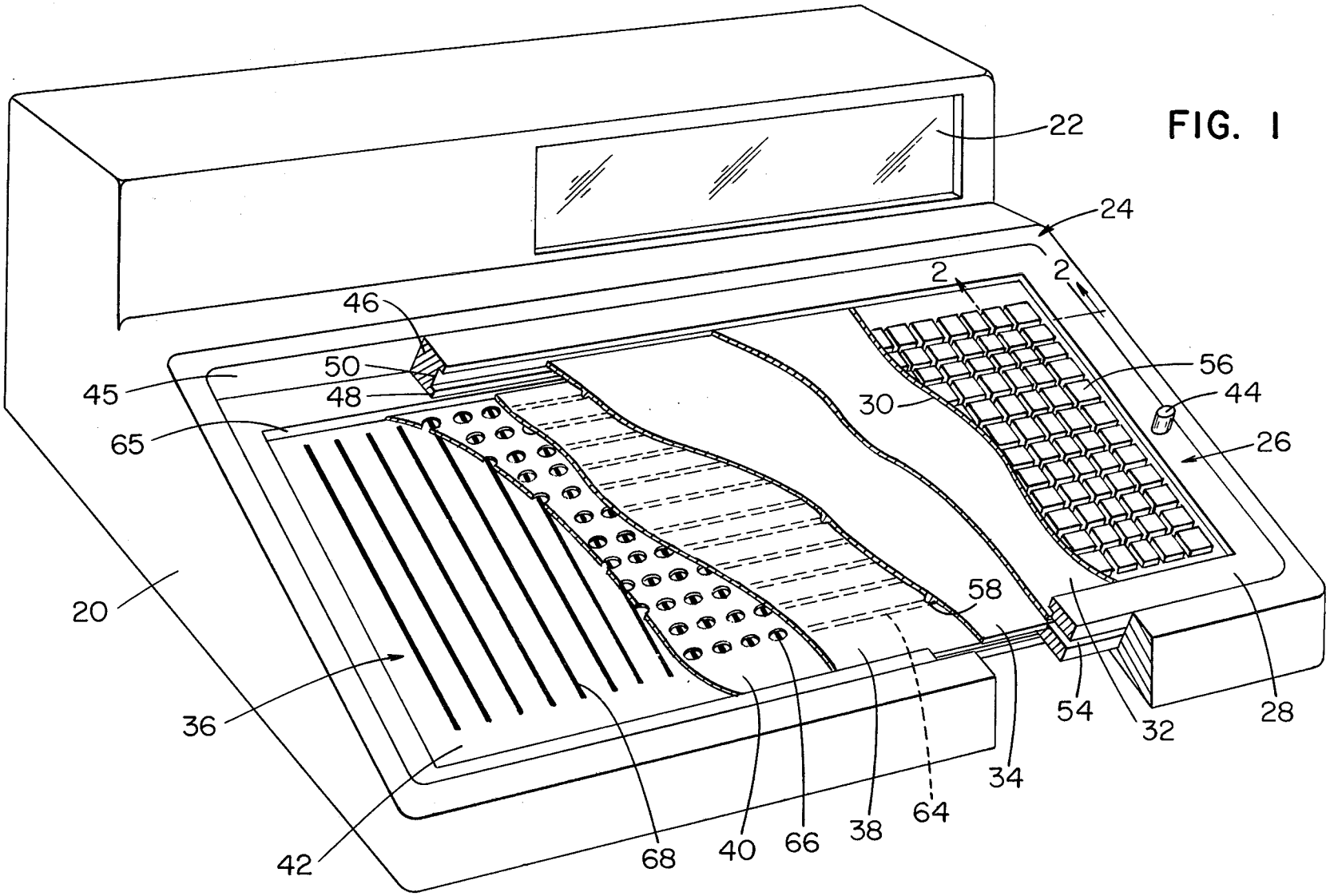
FIG. 1 is a perspective view of a data terminal device having a keyboard constructed in accordance with the present invention, the keyboard being broken away to show the preferred construction thereof.

Referring now to FIG. 1, there is shown in perspective view a data terminal device 20 which includes a conventional display panel 22 and a keyboard constructed in accordance with the present invention and indicted generally by the numeral 24. The keyboard 24 comprises a two part assembly consisting of a jacket unit generally indicated by the numeral 26 and which includes a cover member 28, a key tip sheet 30, an indicia sheet 32 and a projection sheet 34; and of a matrix switch unit generally indicated by the numeral 36 which includes a flexible printed circuit board 38, an insulating sheet 40 and a rigid printed circuit board 42. As will be described more fully hereinafter, the matrix unit 36 may be fixedly secured to the terminal device 20 while the jacket unit 26 is releasably secured to the terminal device by means of a pair of quick release latch members 44, one only of which is shown in FIG. 1.

The cover member 28 of the jacket unit 26 may be of a one piece construction and includes a depending rail portion 46 (FIG. 1) which extends around the periphery of a cavity 45 located in the terminal device 20 in which the present keyboard is located. Thus, it will be seen that the rail portion 46 effectively defines the outline of the keyboard 24.

As best seen in FIG. 1, the inner edge 48 of the rail portion 46 includes a longitudinally extending slot 50 within which is mounted the key tip sheet 30 and the projection sheet 34, the sheets 30 and 34 being mounted in a spaced relationship within the slot 50 to form a pocket 52 (FIG. 2) within which is slidably positioned an indicia sheet 32. The indicia sheet 32 is inserted into the pocket 52 through a slot 54 located in the front edge of the rail portion 46 as shown in FIG. 1 after the jacket unit 26 has been removed from the cavity 45.

Figure 2:
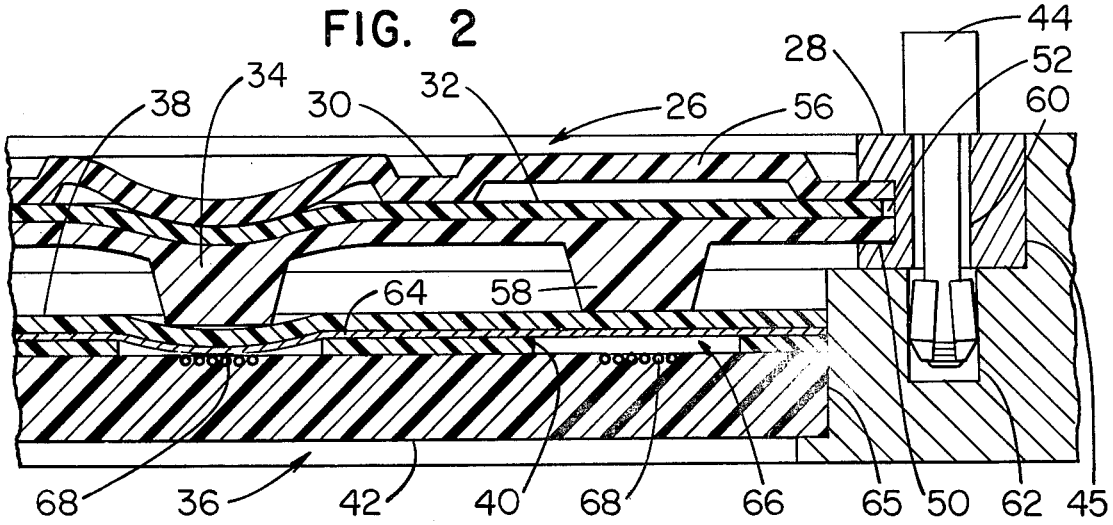
FIG. 2 is a partial cross-sectional view of the keyboard taken on lines 2—2 of FIG. 1 showing details of the construction of the keyboard with a key tip portion in a depressed position and further showing the means for mounting the keyboard jacket to a position adjacent the matrix unit.

As shown more clearly in FIG. 2, the key tip sheet 30 contains a number of raised portions 56 simulating key tips, the sheet 30 being fabricated of any type of transparent plastic material such as plasticized polyvinylchloride or urethane with the raised portions 56 formed in any well known manner such as moulding. As will be described more fully hereinafter, depression of any of the key tip portions 56 will result in the generation of binry signals representing a predetermined numerical value in a manner well known in the art.

Figure 3:
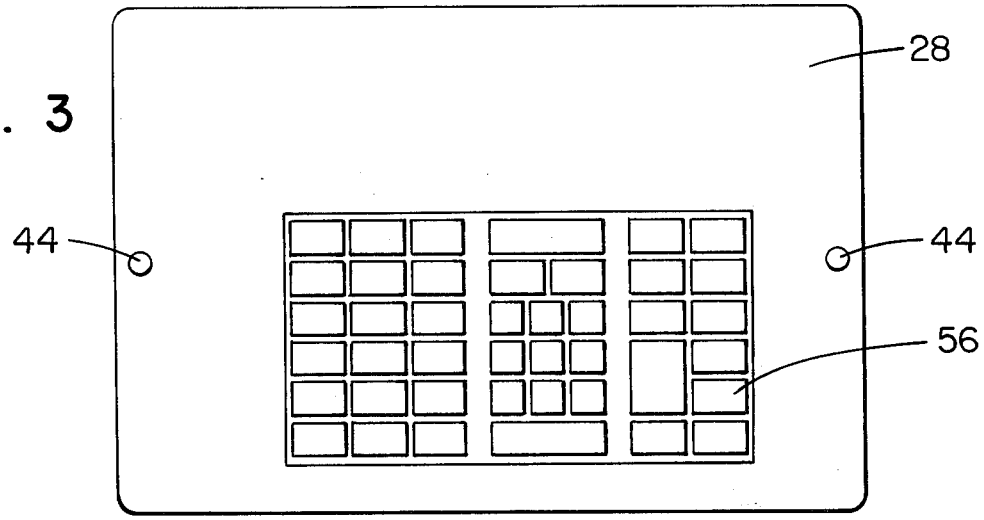
FIG. 3 is a plan view of a one type of keyboard jacket arrangement showing the configuration of the key tip in accordance with the present invention.
Figure 4:
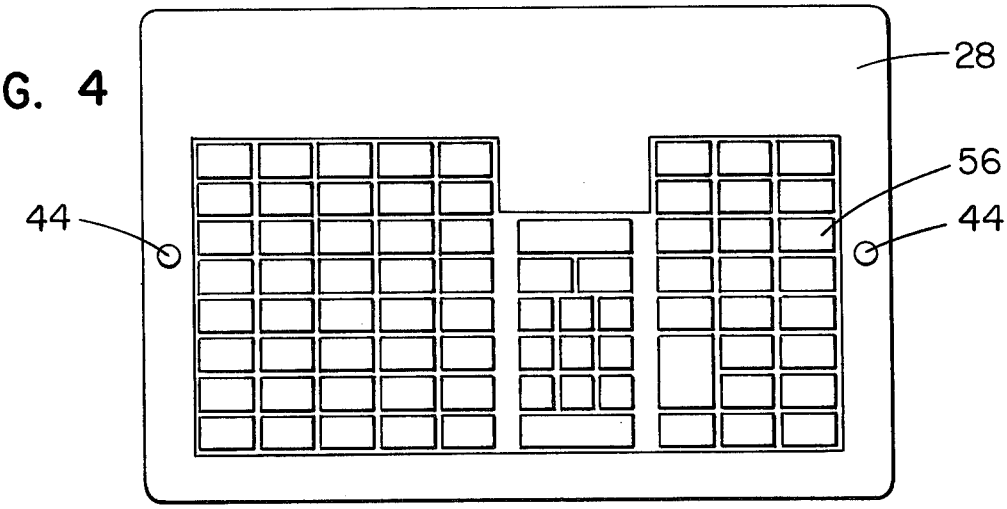
FIG. 4 is a plan view of another keyboard jacket arrangement in accordance with the present invention.

In accordance with one aspect of the present invention, the top edge of the cover member 28 may be constructed to extend over a predetermined number of the raised key tip portions 56 of the sheet 30 in order to prevent their actuation. Thus, as shown in FIGS. 3 and 4, the top surface of the cover member 28 may be formed to expose a certain number and configuration of key tip portions 56 for operation depending on the business requirements in which the terminal device is utilized. As will be described more fully hereinafter, several jacket units 26 each with a predetermined cover configuration can be interchangeably mounted on the keyboard of the terminal device to provide the required number of key tips for different business conditions.

The indicia sheet 32 (FIGS. 1 and 2) which is located under the key tip sheet 30 can be of any type of opaque flexible plastic sheet construction such as polyethylene, polysiopylene, polyethylene terephathlate and the like upon which a plurality of information bearing indicia can be printed. When inserted within the pocket 52 formed by the key tip sheet 30 and the projection sheet 34, each of the printed indicia on the sheet 32 will be positioned beneath as associated key tip portion 56 which, being transparent, will be identified with the indicia so positioned. It is obvious that by inserting other sheets 32 within the pocket 52 each with different indicia printed thereon that a wide variety of key indicia can be accommodated on a single keyboard of the terminal device.

The projection sheet 34 used in the jacket unit 26 and which forms the lower edge of the pocket 52 is rigidly secured to the rail portion 46 in a stretched condition and is composed of a plastic deformable material such as plasticized polyvinylchloride or urethane. The projection sheet 34 is formed to include a plurality of depending projections 58 (FIG. 2) each orientated with an associated key tip portion 56 such that upon depression of the key tip portion 56, the projection 58 will likewise be moved in a downward direction to produce a pressure point on the matrix switch unit 36. Upon release of the pressure on the key tip portion 56, the projection 58 will immediately return to its original position together with the key tip 56 portion due to the stretched condition of the sheet 34. As described previously, the jacket unit 26 is releasably secured to the terminal device 20 by means of a pair of latch members 44 (FIGS. 3 and 4) which are of the type which when depressed by the operator will latch the jacket unit 26 to the terminal device 20. As shown more clearly in FIG. 2, each latch member 44 is inserted into aligned apertures 60, 62 located in the cover member 28 and a portion of the terminal device, respectively. By pulling up upon the latch member 44, the lower end thereof is retracted from the terminal device and the jacket unit 26 thereby is released for quick and easy removal by the operator. One such latch is manufactured under the tradename "NYLATCH" by the Hartwell Corp. It is obvious that other types of latch members can be employed to latch the jacket unit 26 to the keyboard 24 of such terminal device.

Mounted within a lower portion 65 of the cavity 45 of the keyboard 24 is the matrix switch unit 36 consisting of a membrane which may be a flexible printed circuit board 38 (FIG. 2) having a plurality of longitudinal extending electrical conductors 64 embedded in the lower surface of the circuit board 38, a sheet 40 of insulating material such as mylar positioned adjacent the lower surface of the circuit board 38, the sheet 40 including a plurality of apertures 66 each aligned with a projection 58 extending from the jacket unit 26 and a substrate such as a rigid circuit board member 42 acting as the base of the switch unit 36 which includes a plurality of longitudinal extending electrical conductors 68 embedded in the top surface of the circuit board 42 and extending at right angles to the conductors 64 of the circuit board 38. In order to waterproof the matrix switch unit 36 to liquids spilled on the keyboard, such unit itself or at least the edges thereof may be sealed with a plastic or other type of waterproof material so as to prevent any liquids from entering into an area within the matrix switch unit where the conductors 64, 68 would be exposed to the liquids corrosive influence.

In a manner that is well known in the art and is fully disclosed in U.S. Pat. No. 3,592,979 issued to S. A. Redman and which is assigned to the assignee of the present invention, portions of adjacent conductors 64, 68 are selectively exposed to make contact when moved into engagement with each other, thereby generating a binary coded signal. This engagement occurs upon depression of a key tip portion 56 which moves its associated projection 58 into engagement with a portion of the flexible printed circuit board 38, thereby deflecting that portion of the circuit board 38 through the aperture 66 to make contact with the circuit board 42. This movement is shown in FIG. 2. The binary coded signals generated represent the key tip portion 56 that is depressed.

The maximum number of key tip portions 56 that are included in the sheet 30 will determine the number of conductors 64, 68 that will be required to provide different binary signals for each key tip portion. Thus, a strip of eight conductors will provide 255 different binary coded values and therefore can service a keyboard of 255 key tip portions 56. Depression of each key tip portion 56 will result in the generating of a binary signal in which contact between adjacent conductors 64, 68 will represent a one while no contact will represent a zero in the manner fully disclosed in the above-cited U.S. Pat. No. 3,592,979.

From the keyboard construction shown and described herein, it is obvious that any spillage of liquids or food on the jacket unit 26 will not disable the operation of the terminal device 20. By merely removing the jacket unit 26 from the keyboard, the liquids or food can be easily removed and the jacket unit replaced for further operation of the terminal device. By providing jacket units 26 with different cover member 28 configurations, only those key tip portions 56 which are required to be used as demanded by the particular business environment in which the terminal device is being used will be available for operation while those key tip portions 56 not required will be protective from operation. Thus, a misoperation of the keyboard is avoided. in those situations where the key tip indicia is required to be changed, this can be easily accomplished by merely removing the jacket unit 26 and replacing the indicia sheet 32 with a new indicia sheet 32 having the required indicia. It is further obvious that all of these changes will occur in a minimum of time thereby providing very little interruption in the operation of the data terminal device.

While the principles of the invention have now been made clear in an illustrated embodiment, it will be obvious to those skilled in the art that many modifications of structure, arrangements, elements and components can be mde which are particularly adapted for specific environments without departing from those principles. The appended claims are therefore intended to cover and embrace any such modifications within the limits only of the true spirit and scope of the invention.

What is claimed is:

1. A switch-matrix keyboard comprising:

a. a support means;

b. a switch matrix assembly secured to said support means for generating electrical signals in response to the movement of an actuating member to a position engaging a predetermined portion of said assembly;

c. a keyboard assembly operatively associated with said switch matrix assembly and including a number of actuating members each adapted for movement to a position engaging a predetermined portion of said switch matrix assembly;

d. means secured to said keyboard assembly for selectively enabling a predetermined number of said actuating members for movement to said engaging position;

e. and means releasably mounting said keyboard assembly to said support means adjacent said switch matrix assembly whereby keyboard assemblies having different numbers of enabling actuating members may be interchangeably positioned on said support means adjacent said switch matrix assembly.

2. The keyboard of claim 1 in which said enabling means comprises: a cover member extending over a predetermined number of said actuating members in said keyboard assembly thereby disabling the operation of the covered actuating members.

3. The keyboard of claim 2 in which said keyboard assembly further includes:

a. a first sheet of flexible material, portions of which constitute key members;

b. a second sheet of flexible material spaced apart from and forming a pocket with said first sheet of flexible material;

c. an indicia bearing sheet selectively positioned within said pocket to position an indicia adjacent each of said key members;

d. and said cover member has a configuration which overlies certain of said key members thereby disabling said key members from operation, said cover member further includes a depending support portion forming the edge of said keyboard assembly, said first and second sheets of flexible material being secured to the support portion of said cover member forming a waterproof connection with said support portion.

4. A keyboard comprising:

a. support means;

b. a switch matrix secured to said support means having a flexible surface for generating a plurality of electrical signals in response to the movement of an actuating member to a position engaging and depressing a portion of said flexible surface; and c. a keyboard jacket assembly positioned adjacent said switch matrix, said jacket assembly having a lower surface composed of depending projections engaging the flexible surface of said switch matrix and a flexible upper surface, said projections being responsive to deflection of portions of said flexible upper surface for effecting depression of said flexible surface to generate signals, said jacket assembly further including cover means having a configuration which extends over a predetermined portion of said flexible upper surface for disabling the covered portions of the flexible upper surface from being deflected.

5. The keyboard of claim 4 in which said cover means comprises a cover member which includes a depending support portion defining the edge of said jacket assembly, said lower surface and said flexible upper surface being secured to said support portion in a spaced apart and waterproof relationship, said cover member further having a cover portion extending from said flexible upper surface thereby disabling said covered raised portions from being depressed.

6. The keyboard of claim 5 which includes means for releasably mounting said jacket assembly to said support means adjacent said switch matrix whereby a plurality of jacket assemblies each having a different cover portion configuration may be interchanged with said switch matrix.

7. A manually actuable keyboard assembly comprising:

a. a switch matrix comprising a substrate having a first conductor mounted in the top surface thereof;

b. an insulating member positioned on said substrate and having openings therein;

c. a deformable membrane positioned on said insulating member and adapted for movement through said opening, said membrane having second conductors mounted adjacent the opening of said insulating member, and said substrate, insulating member and membrane being secured together in a watertight relationship;

d. a jacket assembly positioned adjacent said membrane and comprising a second substrate having projections depending therefrom in registration with respective openings in said insulating member;

e. a transparent deformable membrane having key portions formed therein, said transparent membrane and said second substrate positioned in spaced apart relationship forming a recessed area;

f. a sheet removably positioned within said recessed area and having indicia thereon aligned with said key portions;

g. and a cover member having a configuration which extends over a predetermined portion of said transparent deformable membrane to expose a predetermined number of said key portions while overlying the remaining key portions whereby only those key portions exposed by said cover member are available for operation.

8. The keyboard assembly of claim 7 which includes a support member supporting said switch matrix and means for releasably mounting said jacket assembly to said support member adjacent said deformable membrane whereby jacket assemblies each having a different cover member configuration may be interchangeable with said deformable membrane to selectively enable predetermined located key portions for operation.

* * * * *

UNITED STATES PATENT OFFICE

CERTIFICATE OF CORRECTION

Patent No. 4,066,850 Dated January 3, 1978

Inventor(s) George Heys, Jr.

It is certified that error appears in the above-identified patent and that said Letters Patent are hereby corrected as shown below:

Column 6, line 22, after "from" insert the following:

-- said support portion over certain of said raised portions of --.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*